United States Patent [19]

Senga

[11] Patent Number: 4,528,969

[45] Date of Patent: Jul. 16, 1985

[54] BLOW-BY GAS RETURNING DEVICE FOR V-TYPE INTERNAL COMBUSTION ENGINE

[75] Inventor: Akihisa Senga, Saitama, Japan

[73] Assignee: Honda Giken Kogyo Kabushiki Kaisha, Tokyo, Japan

[21] Appl. No.: 565,207

[22] Filed: Dec. 23, 1983

[30] Foreign Application Priority Data

Dec. 24, 1982 [JP] Japan ..... 57-202345[U]

[51] Int. Cl.[3] ..... F01M 13/00

[52] U.S. Cl. ..... 123/572; 123/573; 123/574

[58] Field of Search ..... 123/572, 573, 574, 41.86

[56] References Cited

U.S. PATENT DOCUMENTS

| | | | |
|---|---|---|---|
| 1,323,048 | 11/1919 | Goodwin | 123/572 |
| 2,060,883 | 11/1936 | Lowther | 123/572 |
| 3,250,263 | 5/1966 | Gerjets | 123/573 |
| 3,524,437 | 8/1970 | Crandall | 123/573 |
| 3,779,221 | 12/1973 | Gartner | 123/573 |
| 3,846,980 | 11/1974 | DePalma | 123/573 |
| 3,949,719 | 4/1976 | Bellanca | 123/573 |
| 4,269,607 | 5/1981 | Walker | 123/573 |

FOREIGN PATENT DOCUMENTS

| | | | |
|---|---|---|---|
| 1576405 | 4/1970 | Fed. Rep. of Germany | 123/572 |

*Primary Examiner*—Ronald H. Lazarus

*Attorney, Agent, or Firm*—Lyon & Lyon

[57] ABSTRACT

A blow-by gas passage system for an internal combustion engine of the V-type wherein longitudinally spaced passages are formed on each side of, and parallel to, the cylinders in each cylinder bank. Corresponding passages formed in each cylinder head allow for communication between the crankcase and a cavity formed in the space between the two banks of cylinders. An oil separator with a plurality of baffles arranged in a labyrinth-type fashion is mounted on top of the cylinder block and over the collection cavity. An intake manifold is mounted atop the oil separator and has an internal passage formed therethrough corresponding to the exit port of the oil separator. The other end of the intake manifold internal passage is fitted with a PCV-valve which is attached to a pipe leading to the engine air inlet passages of the intake manifold.

8 Claims, 4 Drawing Figures

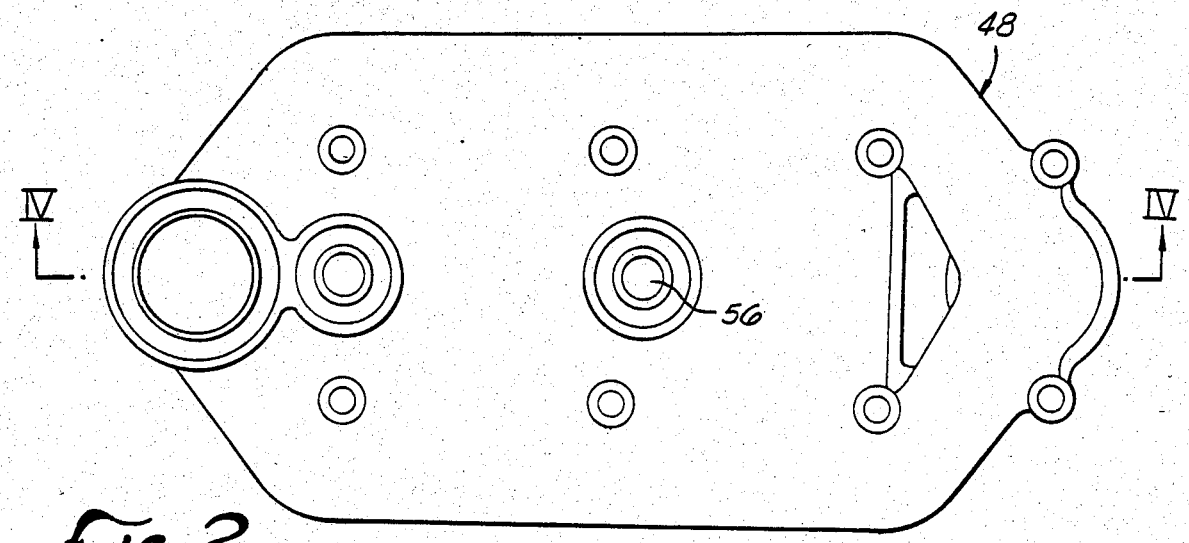
FIG. 2.
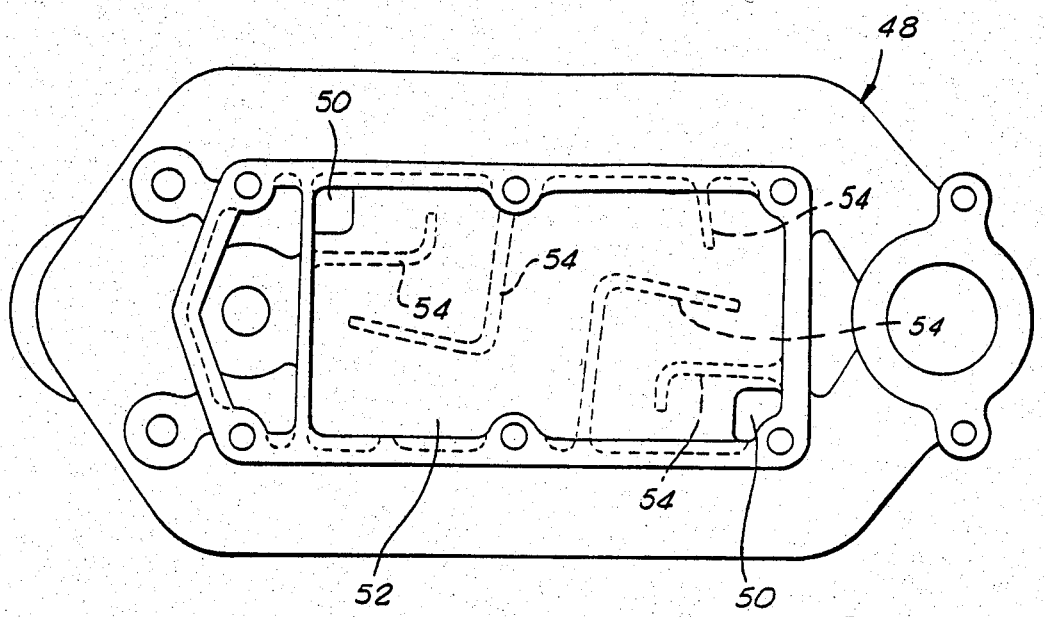
FIG. 3.
FIG. 4.
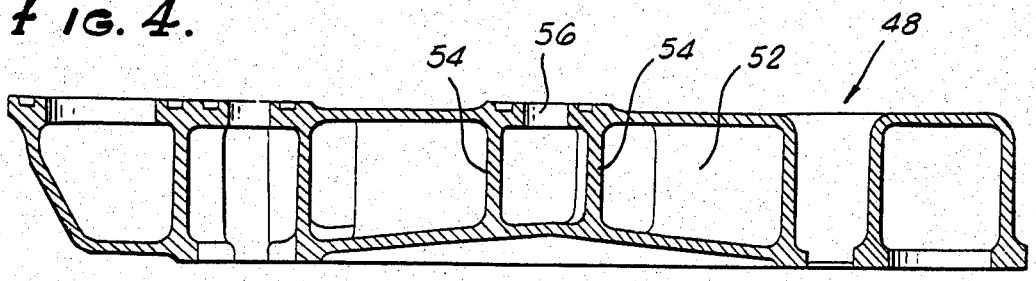

BLOW-BY GAS RETURNING DEVICE FOR V-TYPE INTERNAL COMBUSTION ENGINE

The present device relates to an improvement in a "blow-by" gas returning device for a V-type internal combustion engine, and more particularly, to such a "blow-by" gas passage system in which a series of improved "blow-by" gas passages are formed in the two banks of the cylinder block and the cylinder heads mounted thereon and communicate with a moisture separator located between the two banks.

An internal combustion engine burns an air-fuel mixture which is drawn into the combustion chamber by the action of the pistons. This air-fuel mixture is ignited and burned in the combustion chamber which produces power from the internal combustion engine. Generally speaking, some of this air-fuel mixture will leak into the crankcase through the space between the pistons and the cylinder walls. This gas is known as "blow-by" gas.

It is desirable to recapture this blow-by gas because it typically contains a large amount of unburned fuel. If this blow-by gas is allowed to remain in the crankcase, it will have an adverse effect on the oil retained in the crankcase. In addition, exhausting such blow-by gas contributes to the problems of air pollution and significantly decreases the fuel economy which can be obtained from an internal combustion engine.

Typically, such blow-by gas is piped from the crankcase through a positive crankcase ventilation valve (hereinafter PCV-valve), which regulates the flow of the blow-by gas into the intake manifold, and reburned in the cylinders. Problems can arise from such a system where the PCV-valve is disadvantageously mounted so as to create great difficulty in removal or installation of a new such valve. In addition, it is desirable to use an oil separator in order to remove oil which may be suspended in the blow-by gas prior to re-injection of the gas into the cylinders. A rational arrangement of these components is therefore required, especially in the V-type engine. In addition, such blow-by gas may also contain moisture. It is possible, that such moisture, upon accumulating at the PCV-valve, may freeze when the ambient temperature is low, thereby interfering with the satisfactory operation of the PCV-valve.

It is an object of the present invention to provide a blow-by gas returning device for a V-type internal combustion engine which has few constituent parts in order to ensure the system's simplicity. Another object of the present invention is to provide a blow-by gas returning device for a V-type internal combustion engine which is heated by the engine in order to prevent freezing of moisture contained in the blow-by gas. Another object of the invention is to optimize accessibility to the PCV-valve for mounting or demounting. Additional and further objects of the present invention will become obvious from examination of the specification and drawings contained herein.

In order to achieve the objects of the invention, the present device utilizes passages formed along the cylinder block in each bank of cylinders in the V-type configuration. Such passages correspond to similar passages in the cylinder heads, mounted to the top of each bank of cylinders and a cavity formed in the top of the cylinder block in the space between the two cylinder banks. An oil separator is mounted atop the cylinder block between the two banks of cylinders, and covering the cavity formed therein. An engine intake manifold with an internal passage is mounted on top of the oil separator. The internal passage provides communication between the oil separator and an opening in the top of the intake manifold which is fitted with a PCV-valve. A pipe is used to transport the blow-by gas from the PCV-valve into the engine inlet passages of the intake manifold. As a result, the number of components is reduced to insure simplicity. The mounting of the PCV-valve on top of the intake manifold insures convenient access for removal and installation. In addition, the heat from the engine prevents any moisture in the PCV-valve from freezing and thereby interfering with its operation.

One embodiment in the present device is described in detail herein with reference to the accompanying drawings wherein:

FIG. 2 is a top plan view of the oil separator;

FIG. 3 is a bottom view of the oil separator; and,

FIG. 4 is a cross-sectional view taken substantially along line IV—IV of FIG. 2.

Figure 1:
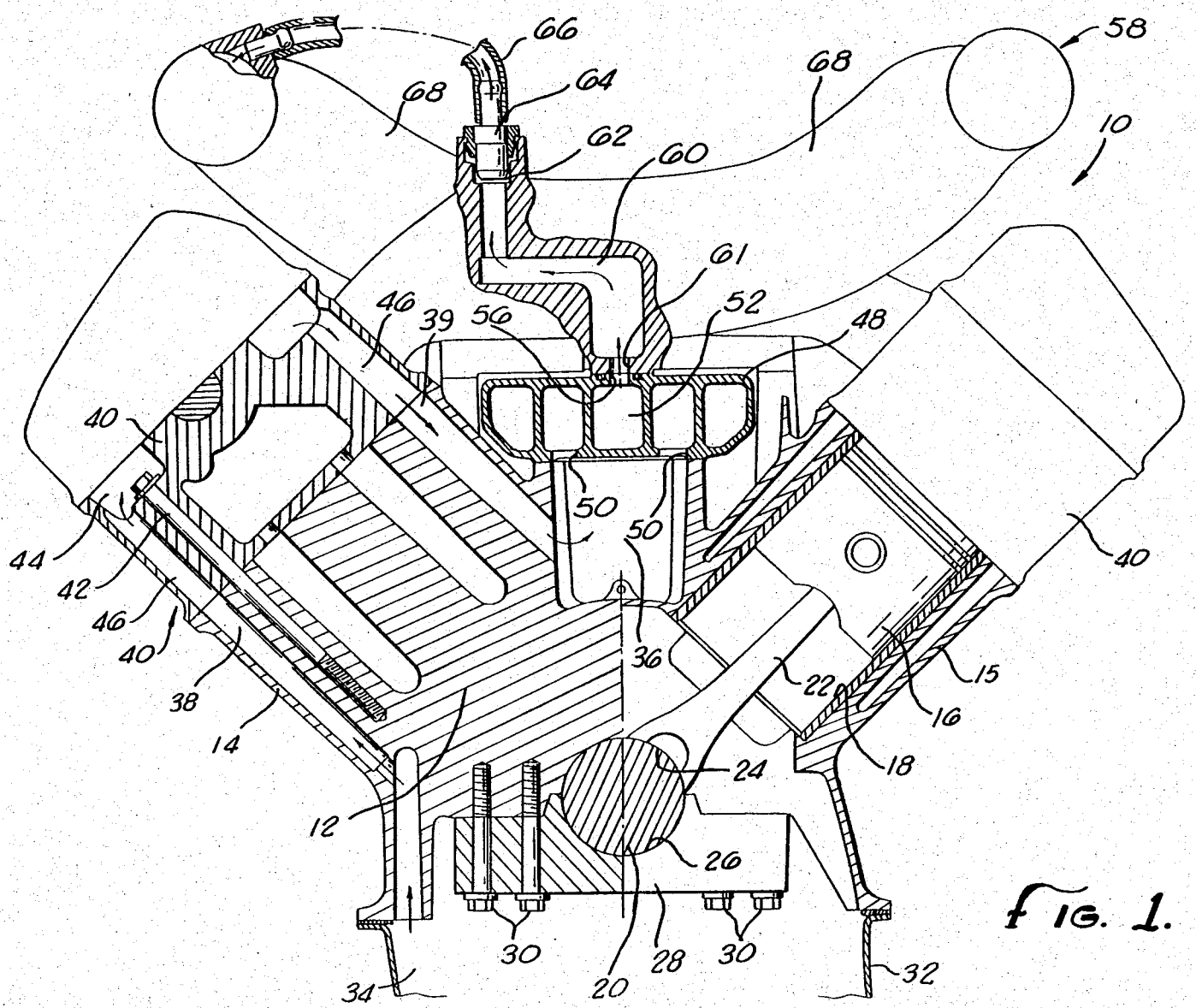
FIG. 1 is a partially broken elevation showing an essential portion of the V-type internal combustion engine which is equipped with a blow-by gas returning device according to the preferred embodiment.

Referring to the drawings, as shown in FIG. 1, the V-type internal combustion engine 10 has a cylinder block 12 which is equipped with a left bank 14 and a right bank 15 in the form of a letter V. Pistons 16 are slideably fitted within the cylinder 18 in the left 14 and right 15 banks. Each piston 16 is connected to a crankshaft 20 by means of a connecting rod 22.

The crank shaft 20 runs in a longitudinal direction of the engine, perpendicular to FIG. 1. The crank shaft 20 is rotatably supported by a split bearing, the upper bearing portion 24 is formed in the nace of the cylinder block 12; the lower bearing portion 26 is formed in the upper face of the bearing cap 28, which is connected to the cylinder block 12 by bolts 30. An oil pan 32 is attached to the bottom of the cylinder block 12, thus creating a crankcase 34 in which lubricating oil may be retained.

A collecting cavity 36 is formed in the upper face of the cylinder block 12 in the space between the left bank 14 and the right bank 15 of the V-type engine 10. Passageways 38, 39 are formed in the cylinder block 12 on both sides of the cylinders 18 containing the pistons 16 in each bank. More than one of each of these passageways 38, 39 may be spaced along the cylinder block in each bank of the V-type engine.

Cylinder heads 40 are attached to the upper face of the left bank 14 and the right bank 15 of the V-type engine 10 by means of cylinder head bolts 42. Cam chambers 44 are formed at the top of each cylinder head 40. In addition, cylinder head passages 46 are formed on each side of the cam chamber 44. These cylinder head passages 46 are spaced so as to align with the cylinder block passages 38, 39 when the cylinder head 40 is mounted to the top of its respective cylinder bank. The outermost cylinder block passages 38 are formed so as to have communication with the crankcase 34. The innermost cylinder block passages 39 are formed so as to have communication with the collecting cavity 36.

An oil separator 48 is mounted to the top of the cylinder block 12 so as to cover the collecting cavity 36. As shown in FIG. 3, the oil separator 48 has two inlet ports 50 formed in opposite corners of its separating chamber 52. A series of baffles 54 protrude from the sides of the oil separator 48 in a labyrinth-type fashion. An exit port 56 is formed in the upper face of the oil separator 48 at a position which corresponds to the center of the oil separating chamber 52.

An intake manifold 58 is mounted on top of the cylinder block 12, in the space between the left bank 14 and right bank 15 of cylinders 18, covering the oil separator 48. A passage 60 is formed within the intake manifold 58. The bottom opening 61 of the internal passage 60 aligns with the exit port 56 in the oil separator 48 when the intake manifold 58 is mounted on top of the cylinder block 12. The upper opening 62 of the intake manifold 58 internal passage 60 is fitted with a PCV-valve 64 to regulate the flow of gases therethrough. A pipe 66 connects the PCV-valve 64 to the engine air inlet passage 68 of the intake manifold 58.

Upon operation of the engine, the invention utilizes the vacuum present in the engine inlet passages 68 to create a vacuum to draw the blow-by gas from the crankcase 34 through the passages in the cylinder block and cylinder head, along the direction of the arrows in FIG. 1, and into the collecting cavity 36. The gas is then drawn into the oil separator 48 through the inlet ports 50 where the swirling action created by the plurality of baffles 54 causes the suspended oil to be removed from the gas. The gas is then drawn through the intake manifold internal passage 60 through the PCV-valve 64 and into the engine air inlet passages 68, where it is reinjected into the cylinders 18 so that a complete burning of the engine fuel may be obtained. The heat generated by the engine prevents any moisture contained in the blow-by gas from freezing when the ambient temperature is low.

We claim:

1. A blow-by gas returning device for V-type engine including an engine block with two banks of cylinders formed therein, two cylinder heads, a crankcase, an intake manifold with upper and lower faces, and engine air inlet passages, comprising, passages formed in the cylinder block parallel to the longitudinal axis of the cylinders, a collection chamber formed in the engine block in the space between the two banks of cylinders, said passages providing communications between the crankcase and said collection chamber, an oil separator with upper and lower mounting surfaces, said lower mounting surface having at least two ports formed therein, said upper mounting surface having one port formed therein, said oil separator having a multiplicity of internal baffles arranged in a labyrinth-type fashion, said oil separator being mounted atop the engine block such that said ports formed in said oil separator lower mounting surface are aligned over said collection chamber formed in the engine block, a passage formed through the intake manifold with openings in the upper and lower faces thereof, said passage lower face opening being aligned with said oil separator upper mounting surface port when the intake manifold is mounted on said oil separator, a PCV-valve fitted in said intake manifold passage upper face opening, and a pipe connecting said PCV-valve to the engine air intake passages.

2. A blow-by gas returning device as set forth in claim 1 wherein a chamber is formed in each cylinder head along the longitudinal axis of the crankshaft and said cylinder block passages provide communication between the crankcase and said cylinder head chamber as well as between said cylinder head chamber and said collection chamber.

3. A blow-by gas returning device for a V-type engine with air inlet ports, cylinders, an intake manifold, a crankcase, an oil separator, and a PCV-valve, comprising, a collection cavity formed in the engine in the space between the "V" created by the cylinders and separate from the crankcase for initial separation of the oil from the blow-by gas, passages formed within the engine providing communication between said cavity and the crankcase, the oil separator being mounted on the engine above and in direct communication with said cavity, the intake manifold being mounted above and connected directly to the oil separator, an opening in the intake manifold, the PCV-valve fitted within said manifold opening, a passage formed through the intake manifold providing communication between the oil separator and the PCV-valve, and means connecting the PCV-valve to the engine air inlet passages.

4. The device of claim 3 including cylinder heads wherein said passages include passages on the outermost sides of the engine communicating the crankcase with the cylinder head on each side and separate passages on the innermost sides of the engine communicating the cylinder heads with said collection cavity.

5. A blow-by gas returning device for a V-type engine including an engine block with two banks of cylinders formed therein, two cylinder heads, a crankcase, an intake manifold with an opening formed in its upper face, engine air inlet passages, a collection cavity formed between the two banks of cylinders, a PCV-valve and means providing communication between the crankcase and the collection cavity, comprising, an oil separator with upper and lower surfaces, said lower surface being mounted to the engine block above and in direct communication with the collection cavity, the intake manifold being mounted on said oil separator upper surface, a passage formed through the intake manifold providing communication for said oil separator to the intake manifold upper face opening, and means providing communication from the intake manifold opening to the engine air inlet passages including the PCV-valve.

6. The blow-by gas return device of claim 3 wherein said collection cavity and said oral separator extend a substantial proportion of the length of the engine, said collection cavity is open in the upward direction, and said oil separator covers the upward opening of said collection cavity.

7. The blow-by gas return device of claim 6 wherein said oil separator is relatively flat and extends horizontally in the longitudinal and lateral directions to substantially fill the space between the "V" created by the cylinders.

8. The blow-by gas return device of claim 5 wherein said oil separator is relatively flat and extends horizontally in both the longitudinal and lateral directions to substantially fill the space between the two banks of cylinders of the "V" type engine.

* * * * *

UNITED STATES PATENT AND TRADEMARK OFFICE

CERTIFICATE OF CORRECTION

PATENT NO. : 4,528,969

DATED : July 16, 1985

INVENTOR(S) : Akihisa Senga

It is certified that error appears in the above—identified patent and that said Letters Patent is hereby corrected as shown below:

Column 2, line 34 change "nace" to --lower face--.

Signed and Sealed this

*Fifteenth* Day of *July 1986*

[SEAL]

*Attest:*

DONALD J. QUIGG

*Attesting Officer*

*Commissioner of Patents and Trademarks*